US008230549B2

(12) United States Patent
Lenkiewicz et al.

(10) Patent No.: US 8,230,549 B2
(45) Date of Patent: Jul. 31, 2012

(54) UPRIGHT EXTRACTOR

(75) Inventors: Kenneth M. Lenkiewicz, Grand Rapids, MI (US); Phong H. Tran, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 684 days.

(21) Appl. No.: 12/403,816

(22) Filed: Mar. 13, 2009

(65) Prior Publication Data

US 2009/0229069 A1 Sep. 17, 2009

Related U.S. Application Data

(60) Provisional application No. 61/036,620, filed on Mar. 14, 2008.

(51) Int. Cl.
*A47L 7/00* (2006.01)

(52) U.S. Cl. ..... 15/320; 15/321; 15/322; 15/355; 15/356

(58) Field of Classification Search ..... 15/320, 15/321, 322, 355, 356
See application file for complete search history.

(56) References Cited

U.S. PATENT DOCUMENTS

| | | | | |
|---|---|---|---|---|
| 1,912,386 | A * | 6/1933 | Replogle | 15/377 |
| 3,775,951 | A | 12/1973 | Eichholz et al. | |
| 4,887,330 | A | 12/1989 | Woodhall et al. | |
| 6,131,237 | A * | 10/2000 | Kasper et al. | 15/320 |
| 6,662,402 | B2 | 12/2003 | Giddings et al. | |
| 6,735,812 | B2 | 5/2004 | Hekman et al. | |
| 7,904,990 | B1 * | 3/2011 | Miner | 15/320 |
| 2009/0265876 | A1 | 10/2009 | Gardner et al. | |

FOREIGN PATENT DOCUMENTS

| | | | |
|---|---|---|---|
| DE | 2443638 | A1 | 3/1973 |
| DE | 3231679 | A1 | 3/1984 |
| GB | 2141330 | A | 12/1984 |
| GB | 2141523 | A | 12/1984 |
| GB | 2248101 | A | 3/1992 |
| GB | 2334667 | A | 1/1999 |
| GB | 2360200 | A | 9/2001 |
| GB | 2377624 | B | 6/2005 |

* cited by examiner

*Primary Examiner* — Lee D Wilson
*Assistant Examiner* — Shantese McDonald
(74) *Attorney, Agent, or Firm* — McGarry Bair PC

(57) ABSTRACT

An upright extractor for delivering cleaning fluid to a cleaning member, removing the cleaning fluid and entrained soil from the cleaning member, and damp wiping dirt and debris off of a surface to be cleaned. A roller assembly for wiping dirt and debris off a cleaning surface is reversible. The roller assembly and a centrifugal pump are driven simultaneously and at independent speeds necessary for preferred operation with a common motor. A vented spray tip assembly delivers cleaning fluid to the cleaning member. An improved accessory tool delivers a variety of metered cleaning chemicals while also extracting the soiled fluid and debris from a surface to be cleaned.

17 Claims, 13 Drawing Sheets

UPRIGHT EXTRACTOR

CROSS-REFERENCE TO RELATED APPLICATIONS

This application claims the benefit of U.S. Provisional Patent Application No. 61/036,620, filed Mar. 14, 2008, which is incorporated herein by reference in its entirety.

BACKGROUND OF THE INVENTION

1. Field of the Invention

The invention relates to an upright extractor for delivering cleaning fluid to a surface to be cleaned and removing the cleaning fluid from the surface to be cleaned. In one of its aspects, the invention relates to a reversible roller assembly for applying cleaning solution and wiping dirt and debris off a surface to be cleaned in a manner that reduces carpet wetness and drying time. In another of its aspects, the invention relates to a means for driving a roller assembly and a centrifugal pump simultaneously and at independent speeds. In yet another of its aspects, the invention relates to a user-removable vented spray tip assembly that improves performance of the fluid delivery system. In still another aspect, the invention relates to an improved accessory tool capable of delivering metered cleaning chemicals targeted at specific cleaning requirements while also providing means to extract the soiled fluid and debris from the surface to be cleaned.

2. Description of the Related Art

Upright extractors are known for deep cleaning carpets and other fabric surfaces, such as upholstery. Most carpet extractors comprise a fluid delivery system, a fluid recovery system, and optionally an agitation system. The fluid delivery system typically includes one or more fluid supply tanks for storing a supply of cleaning fluid, a fluid distributor for applying the cleaning fluid directly to the surface to be cleaned or to an intermediate cleaning member that subsequently contacts the surface to be cleaned, and a fluid supply conduit for delivering the cleaning fluid from the fluid supply tank to the fluid distributor. The fluid recovery system typically comprises a recovery tank, a nozzle adjacent the surface to be cleaned (or in contact with an intermediate cleaning member in direct contact with the surface to be cleaned) and in fluid communication with the recovery tank through a working air conduit, and a vacuum source in fluid communication with the working air conduit to draw the cleaning fluid from the surface to be cleaned through the nozzle and the working air conduit to the recovery tank. The agitation system can include an agitator element for scrubbing the surface to be cleaned, an optional drive means, and selective control means. The agitation system can include a fixed or driven agitator element that can comprise a brush, pad, sponge, cloth, and the like. The agitation system can also include driving and control means including motors, turbines, belts, gears, switches, sensors, and the like. An example of an upright extractor is disclosed in commonly assigned U.S. Pat. No. 6,131,237 to Kasper et al.

U.S. Pat. No. 6,662,402 to Giddings et al. discloses a soil transfer extraction cleaning method employing a roller assembly including a soil transfer cleaning medium to mechanically remove soil from the surface to be cleaned. The method includes the steps of successively and repeatedly wetting a portion of the cleaning medium with a cleaning liquid, extracting any soil and at least some of the cleaning liquid from the previously wetted portion of the cleaning medium, and wiping the surface to be cleaned with the cleaning medium so as to transfer soil from the surface to be cleaned to the cleaning medium.

U.S. Pat. No. 6,735,812 to Hekman et al. discloses an apparatus having a cleaning implement in selective wiping contact with the surface to be cleaned; a cleaning solution dispenser that selectively wets a portion of the cleaning implement, a portion of the surface to be cleaned, or both; a first selectively controllable vacuum extractor tool to remove some of the dispensed cleaning solution and soil from the cleaning implement; and a second selectively controllable vacuum extractor tool which removes soil and some of the cleaning solution directly from the surface to be cleaned.

Traditionally, carpet extractors deliver cleaning fluid directly to a surface to be cleaned or onto an agitation system which subsequently delivers the cleaning solution to the surface to be cleaned. In both cases, the surface to be cleaned is saturated with cleaning fluid and allowed to dwell a sufficient amount of time in order to maximize the efficiency of the chemical process. In a second step, the cleaning solution together with any entrained debris is removed from the surface to be cleaned and collected via the fluid recovery system. This extraction process commonly leaves behind significant residual moisture in the surface to be cleaned, which is undesirable to the user because the cleaned surface is unusable until sufficiently dry. Further, if residual moisture remains in the surface to be cleaned for an extended time, mold, mildew, and the like can form and thus creates a new set of issues for the user. The present invention employs an alternative fluid distribution, agitation, and extraction system that reduces the amount of fluid applied to the surface to be cleaned, thus minimizing the residual moisture.

SUMMARY OF THE INVENTION

According to the invention, an upright extractor comprises a foot assembly including base housing for movement along a surface to be cleaned, a fluid supply system mounted to the base housing and including a fluid tank, a fluid distributor for depositing fluid onto the surface to be cleaned, and a fluid conduit between the fluid tank and the fluid distributor. A fluid recovery system is mounted to the base housing and includes a suction nozzle, a recovery tank, a working air conduit between the suction nozzle and the recovery tank, and a motor/fan assembly adapted to draw liquid through the suction nozzle and deposit the liquid in the recovery tank.

The distributor comprises a spray tip housing having an inlet opening connected to the fluid conduit; and an outlet opening connected to a spray nozzle, a chamber formed in the spray tip housing in communication with the inlet opening and the outlet opening; and a vent opening in communication with the atmosphere and with the chamber; a float valve mounted in the chamber and moveable from a sealing position in sealing relationship with the vent opening to seal the chamber from the atmosphere when fluid under pressure is delivered to the chamber from the fluid conduit and a vent position in spaced relationship with the vent opening to vent the chamber to the atmosphere when the fluid in the fluid conduit is unpressurized.

In one embodiment, the spray tip housing has a cap opening between the atmosphere and the chamber and a cap removably mounted in the cap opening, and wherein the vent opening is formed in the cap.

In another embodiment, a removable panel mounted in the base housing directly above the spray tip housing for user access to the spray tip housing. Further, the cap can be positioned directly adjacent the removably panel. Further, at least a portion of the removable panel is at least translucent for user visibility to the spray tip housing. The spray tip assembly can be removably mounted in the base housing.

In another embodiment, a roller having an outer layer of a soft cleaning medium mounted to the base housing for contact with a surface to be cleaned and the spray tip housing is mounted in the base housing in a position to distribute cleaning fluid from the spray nozzle onto the surface of the roller cleaning medium to apply cleaning fluid to the surface to be cleaned. A deflection wall can be mounted above the roller and in registry with the spray nozzle, whereby cleaning fluid sprayed from the spray nozzle impinges on the deflection wall and drips onto the soft cleaning medium of the roller.

In another embodiment, the suction nozzle can have a suction opening positioned in contact with the soft cleaning medium of the roller to remove fluid and debris therefrom.

In another embodiment, the roller can be mounted to the base housing for selective placement in two mutually exclusive positions 180 degrees perpendicular to the axis of the roller. A drive motor operably can be connected to the roller, and brush gears can mount the roller to the base housing for providing slippage between the roller and the drive motor in the event that a resistance created by the roller exceeds a predetermined limit.

In another embodiment, the roller has brush gears at each end that interfaces with a drive mechanism for driving the roller about a longitudinal axis.

Still further according to the invention, an upright extractor comprises a foot assembly including base housing for movement along a surface to be cleaned, a fluid supply system mounted to the base housing and including a fluid tank, a fluid distributor for depositing fluid onto the surface to be cleaned, and a fluid conduit between the fluid tank and the fluid distributor. A fluid recovery system is mounted to the base housing and includes a suction nozzle, a recovery tank, a working air conduit between the suction nozzle and the recovery tank, and a motor/fan assembly adapted to draw liquid through the suction nozzle and deposit the liquid in the recovery tank. A roller element is removably and reversibly mounted in base housing for contacting the surface to be cleaned.

In one embodiment, the roller can have an outer layer of a soft cleaning medium mounted to the base housing for contact with a surface to be cleaned. Further, the roller can have brush gears at each end that interfaces with a drive mechanism for driving the roller about a longitudinal axis.

In another embodiment, an accessory stain tool assembly is removably attached to a handle assembly, the accessory stain tool including a suction nozzle fluidly connected to the recovery tank and to the motor/fan assembly, and an accessory fluid distributor that is fluidly connected to the fluid tank, a pump between the accessory fluid distributor and the fluid tank, a solution reservoir adapted to hold a stain remover composition, and a venturi connected to the solution reservoir and to the accessory fluid distributor to supply the stain remover composition from the solution reservoir to the accessory fluid distributor.

DESCRIPTION OF THE PREFERRED EMBODIMENT

Figure 1:
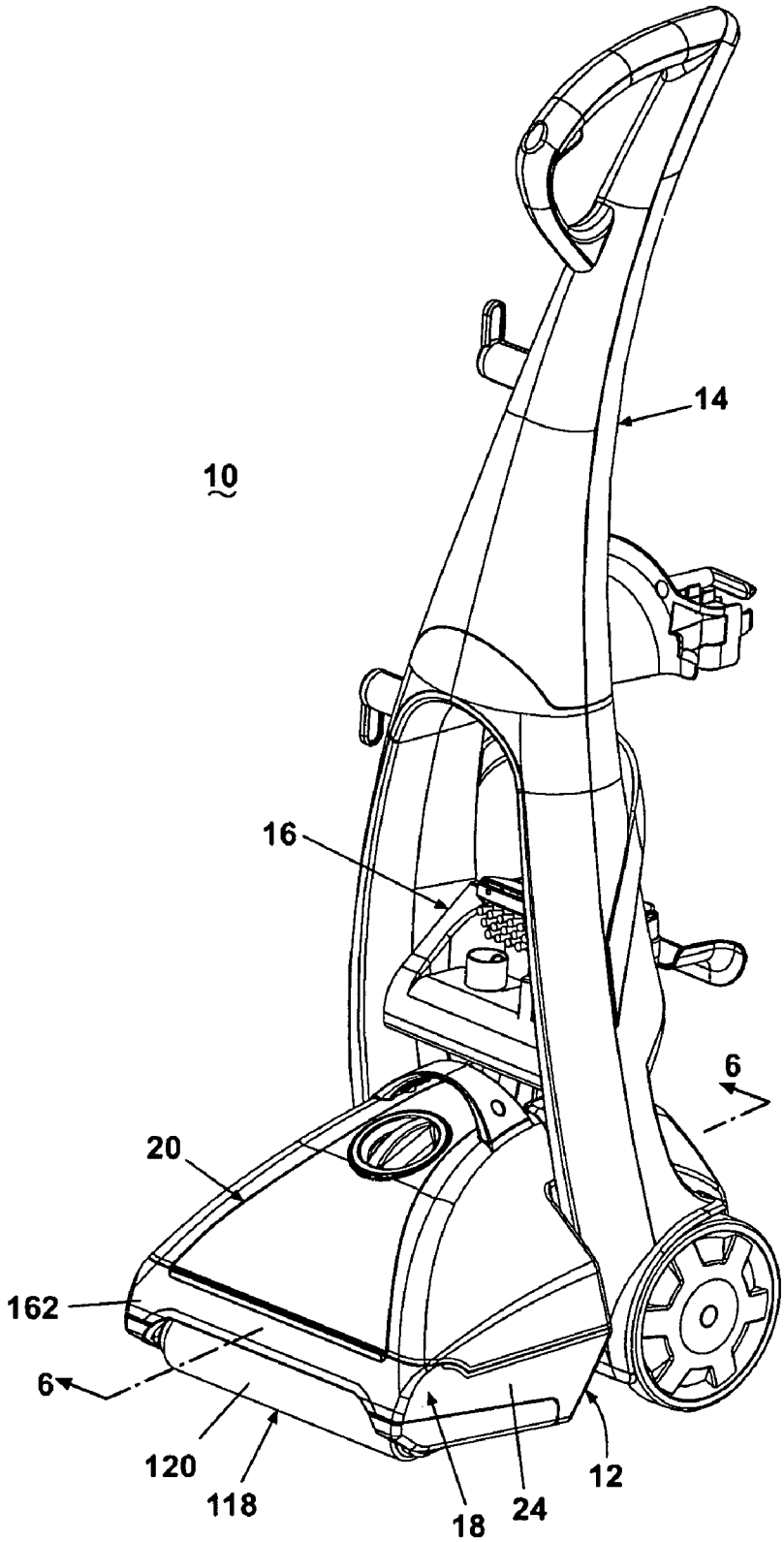
FIG. 1 is a front perspective view of an upright extractor according to the invention.
Figure 2:
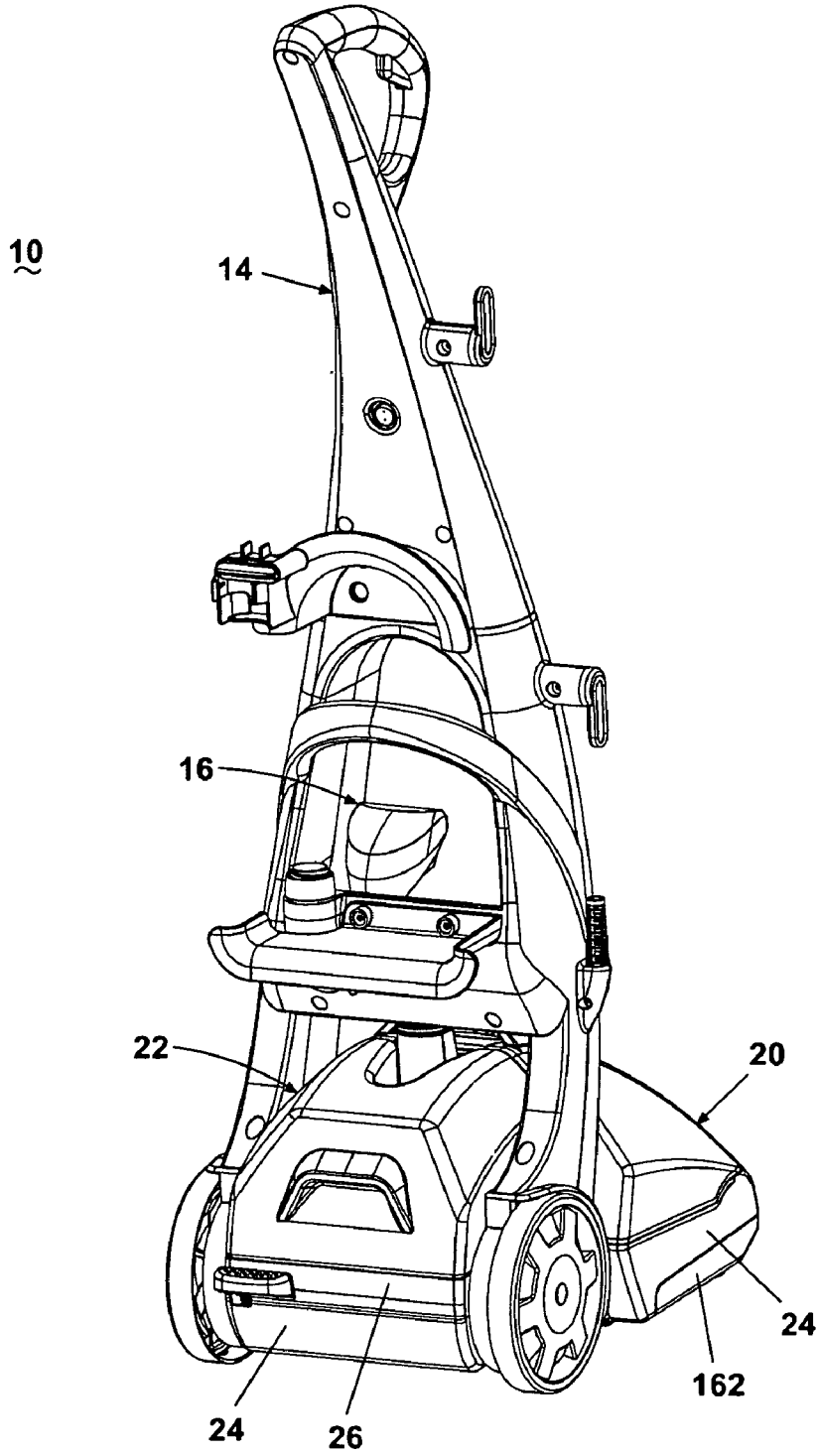
FIG. 2 is a rear perspective view of the upright extractor of FIG. 1.
Figure 3:
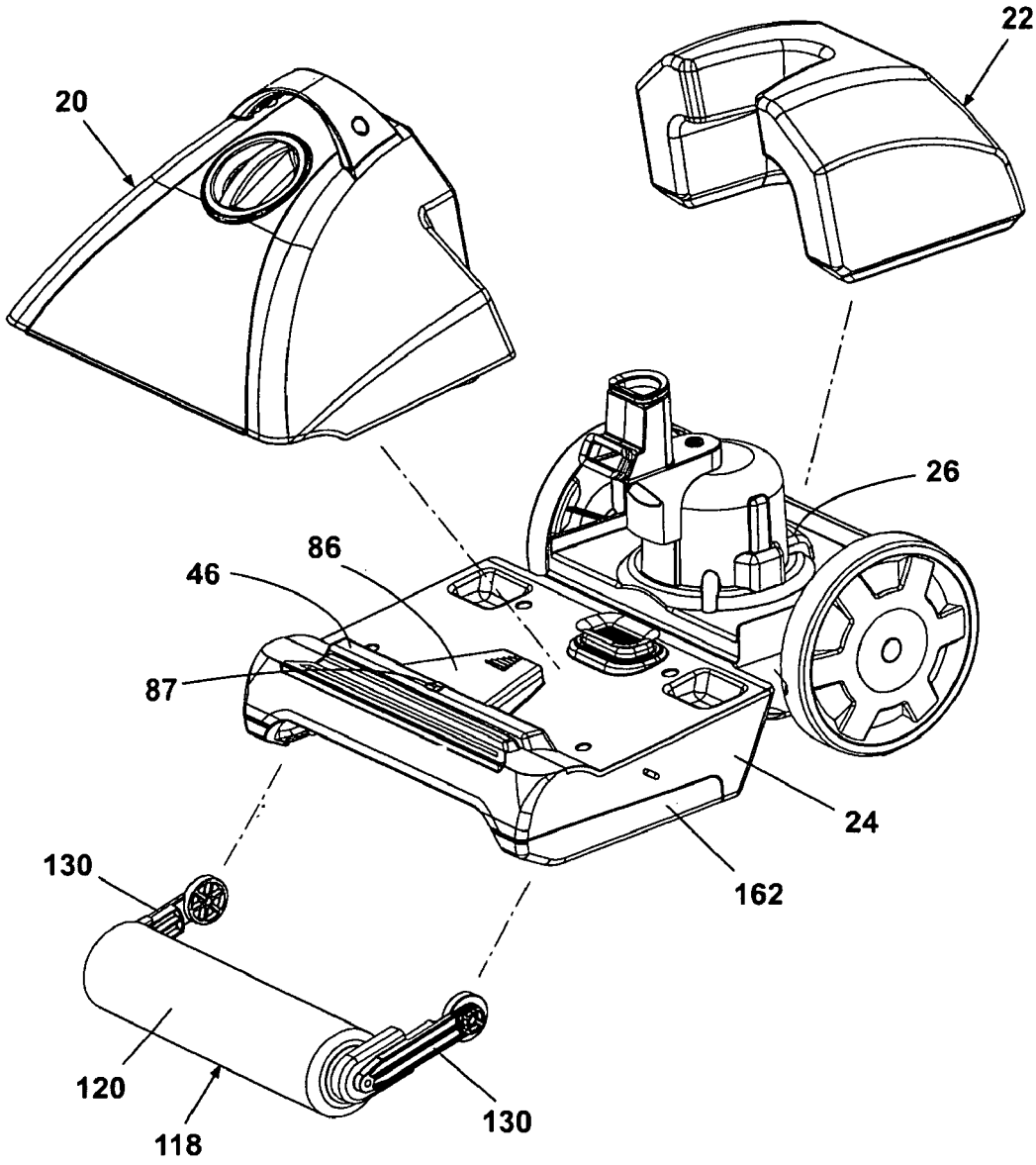
FIG. 3 is a partial exploded perspective view of a foot assembly of FIG. 1.
Figure 4:
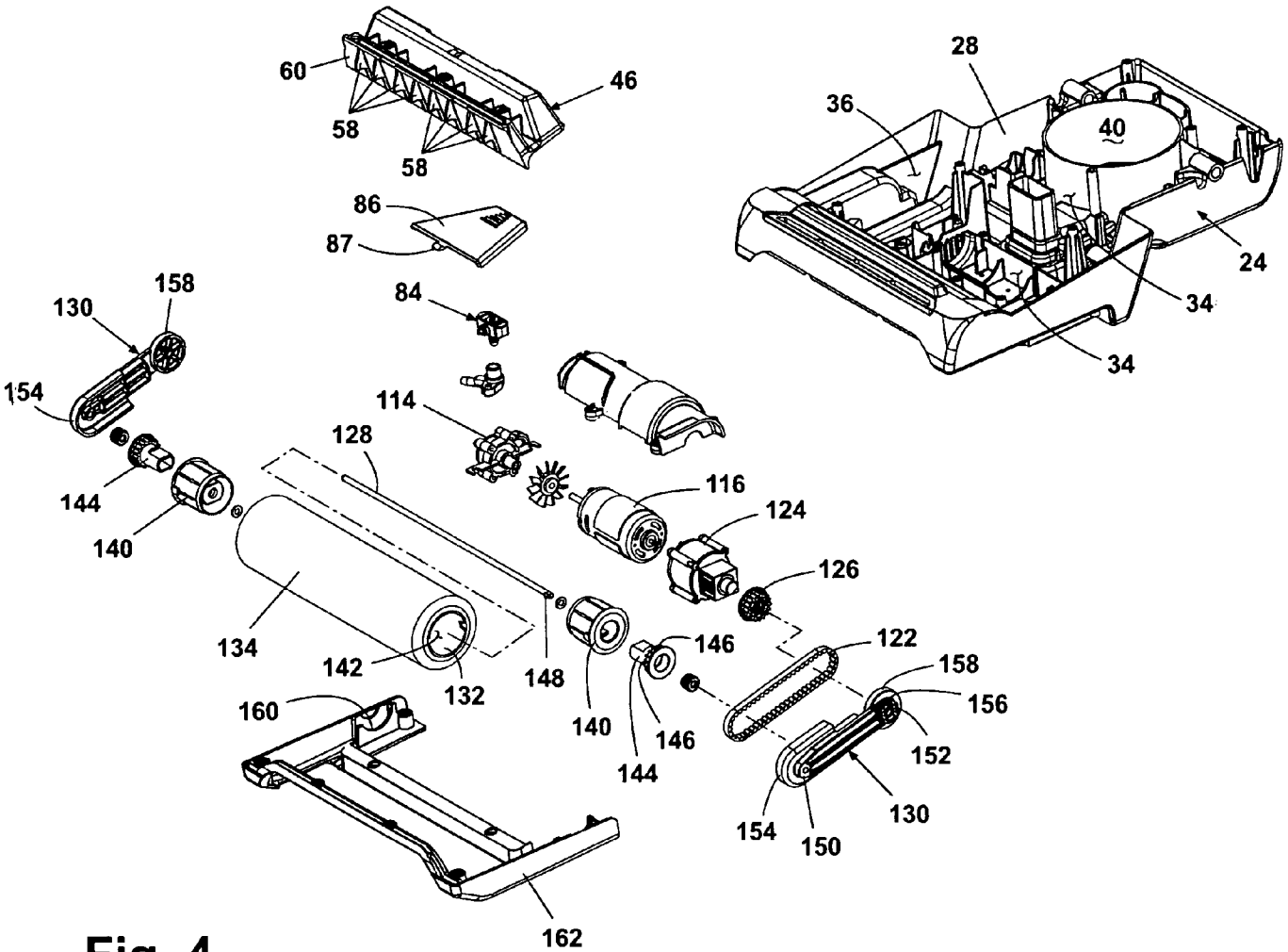
FIG. 4 is a partial exploded perspective view of the foot assembly of FIG. 1.

Referring to the figures, and in particular to FIGS. 1-4, an upright extractor 10 comprises a foot assembly 12 and a handle assembly 14 pivotally mounted to the foot assembly 12 for directing the upright extractor 10 across a surface to be cleaned. An accessory stain tool assembly 16 is removably attached to the handle assembly 14. The upright extractor 10 comprises commonly known components of a fluid distribution system and a fluid extraction system, including a recovery tank assembly 20 and a fluid supply tank assembly 22 in the foot assembly 12. The foot assembly 12 further comprises a base assembly 18 having a base housing 24 mounted to a base housing cover 26. The various housing and structural elements of the upright extractor 10, including the handle assembly 14, base housing 24 and base housing cover 26, can be formed of any material or combination of materials suitable for the purposes described herein, such as a durable and relatively rigid molded plastic. An example of an upright extractor is disclosed in U.S. Pat. No. 6,131,237 to Kasper et al., which is incorporated herein by reference in its entirety.

Figure 5:
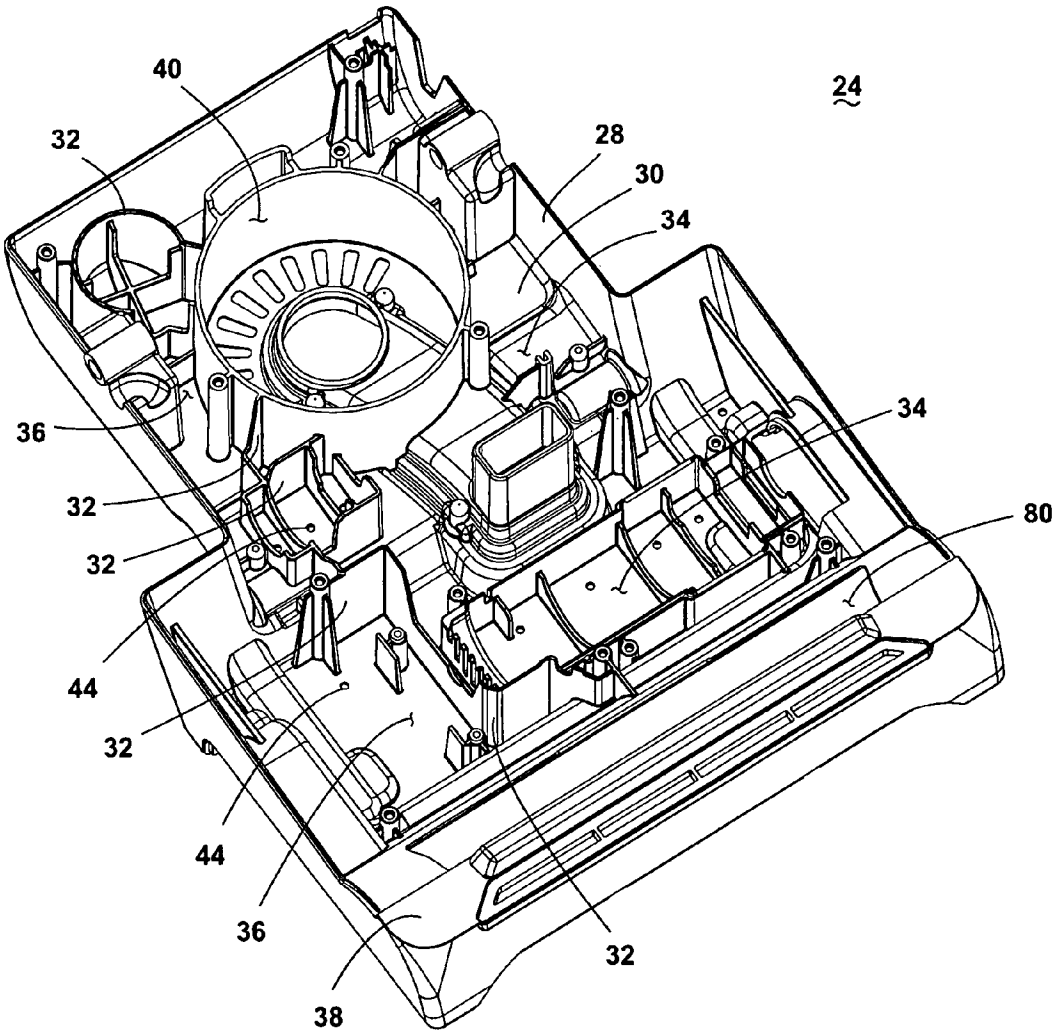
FIG. 5 is a perspective view of a base housing as shown in FIG. 4.

Referring also to FIG. 5, the base housing 24 comprises a supporting tray structure 28 having a bottom wall 30 and a plurality of vertically-oriented fluid barrier ribs 32 that collectively form an electrical component cavity 34 and a fluid component cavity 36. The various housing and structural elements of the upright extractor 10, including the supporting tray structure 28, can be formed of any material suitable for the purposes described herein, such as a durable and relatively rigid molded plastic. A roller housing 38 can be formed at a forward portion of the base housing 24. The electrical component cavity 34 comprises a motor cavity 40 that receives a conventional motor/fan assembly 42. The electrical component cavity 34 also receives conventional electrical components, for example but not limited to motors, switches, and wiring. The fluid component cavity 36 receives conventional fluid handling components, for example but not limited to tubing, valves, pumps, and fluid fittings. A plurality of relief apertures 44 are formed in the bottom wall 30 of the supporting tray structure 28 throughout the fluid component cavity 36 and electrical component cavity 34 to drain or remove liquid that may leak from any of the fluid handling components within the interior of the supporting tray structure 28.

Figure 6:
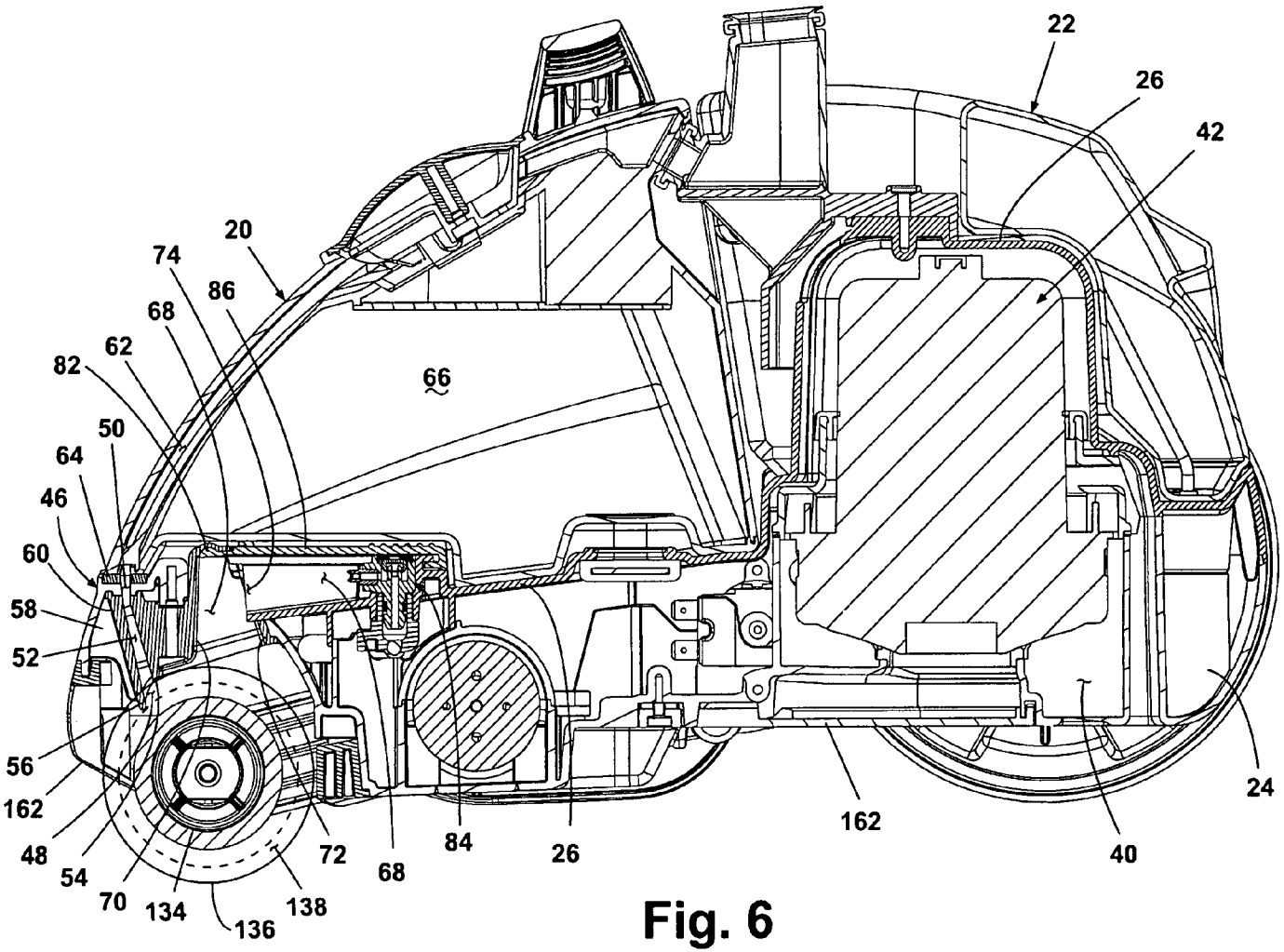
FIG. 6 is a cross-sectional view of the foot assembly of FIG. 1 taken along line 6-6 with a roller assembly in a rest position.
Figure 7:
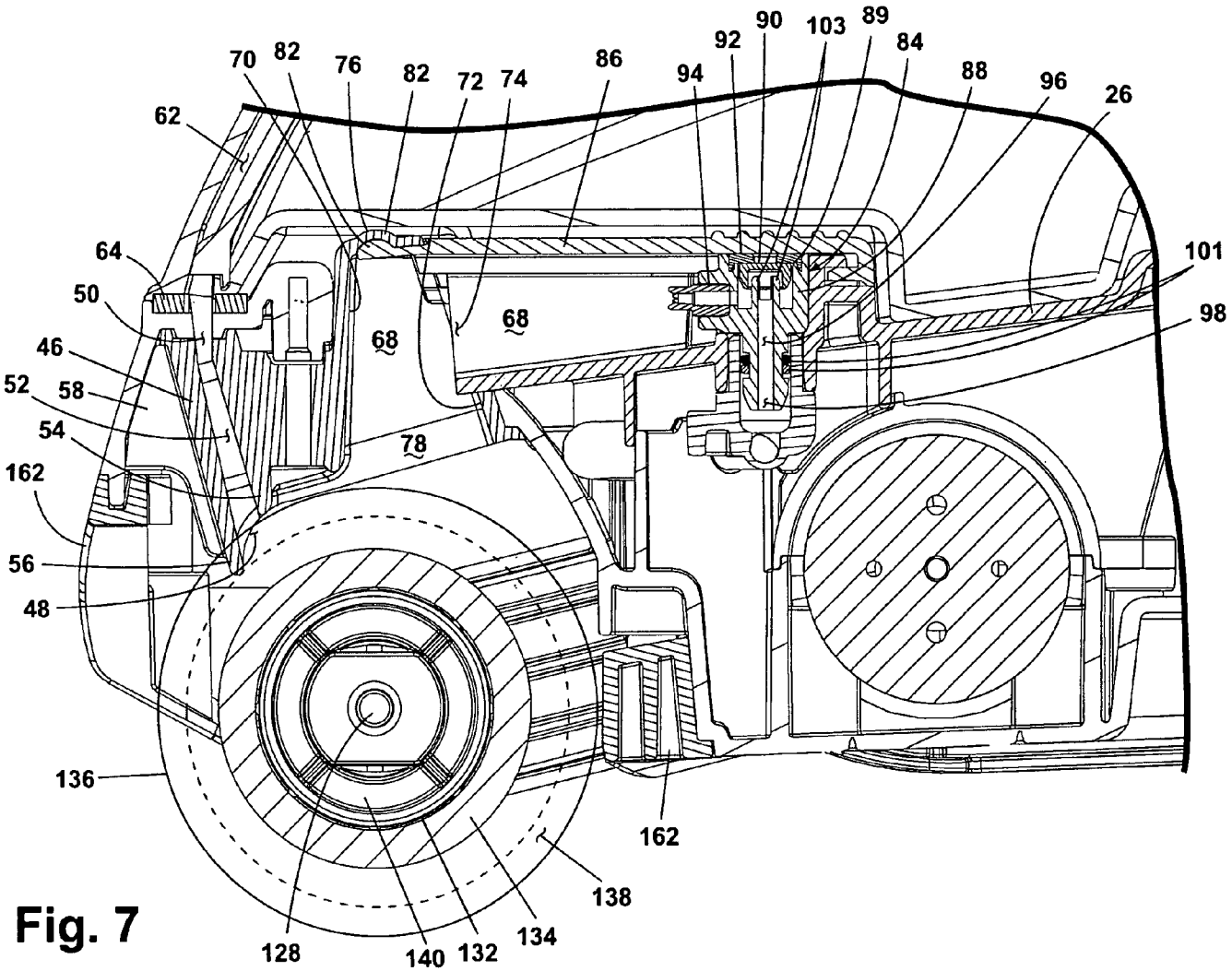
FIG. 7 is enlarged cross-sectional view of a portion of the foot assembly of FIG. 6 with the roller assembly in an in-use position.

Referring also to FIGS. 6 and 7, a working air path can be formed through the base housing 24 via a nozzle insert housing 46. The nozzle insert housing 46 forms a nozzle inlet 48, a nozzle outlet 50, and a first flowpath 52 therethrough. The nozzle inlet 48 further comprises a leading nozzle wall 54 and a trailing nozzle wall 56. The trailing nozzle wall 56 can be longer than the leading nozzle wall 54 and facilitates the extraction process as is more fully described in the operation description below. The nozzle insert housing 46 can be assembled to the base housing 24 in any suitable manner, such as by using conventional fasteners or by a snap fit.

The first flowpath 52 can be oriented at an angle relative to vertical such that the nozzle outlet 50 is positioned slightly forward of the nozzle inlet 48. In one embodiment, the nozzle outlet 50 is 13 degrees forward of the nozzle inlet 48 relative to vertical. The orientation of the nozzle outlet 50 to nozzle inlet 48 can range from 45 degrees forward to 45 degrees rearward relative to vertical.

The nozzle insert housing 46 further comprises plurality of integrally-formed raised stiffening ribs 58 (see also FIG. 4) that protrude from a front side 60 of the trailing nozzle wall 56. The stiffening ribs 58 mate to an inside surface of the front of the roller housing 38 (FIG. 5) and increase the rigidity of the first flowpath 52. The first flowpath 52 is in fluid communication with a corresponding second flowpath 62 formed in the recovery tank assembly 20 in a well-known manner. A resilient gasket 64 seals the second flowpath 62 within the base housing 24. The second flowpath 62 terminates in an air/separation chamber 66 comprising features to effectively separate liquid from the working air stream as are well-known. Such features can include but are not limited to structural elements such as projections or ribs within the air/separation chamber 66 configured to direct moisture downwardly within the air/separation chamber 66. A suitable recovery tank assembly incorporating a second flowpath and a liquid separation means is shown in U.S. Pat. No. 6,131,237 to Kasper et al. and is incorporated herein by reference in its entirety.

The nozzle insert housing 46 further comprises a deflection wall 70 and a back wall 72 with a receiving aperture 74 formed therein that together form a portion of a spray distribution compartment 68. The spray distribution compartment 68 is further bounded by a compartment top wall 76 and a bottom opening 78 formed by the nozzle insert housing 46. The spray distribution compartment 68 is in fluid communication with the interior of the roller housing 38. The spray distribution compartment 68 can be received within a spray cavity aperture 80 (FIG. 5) formed in the roller housing 38. The nozzle insert housing 46 top wall 76 engages with a mating rib 82 that protrudes from a spray tip cover 86.

Figure 8:
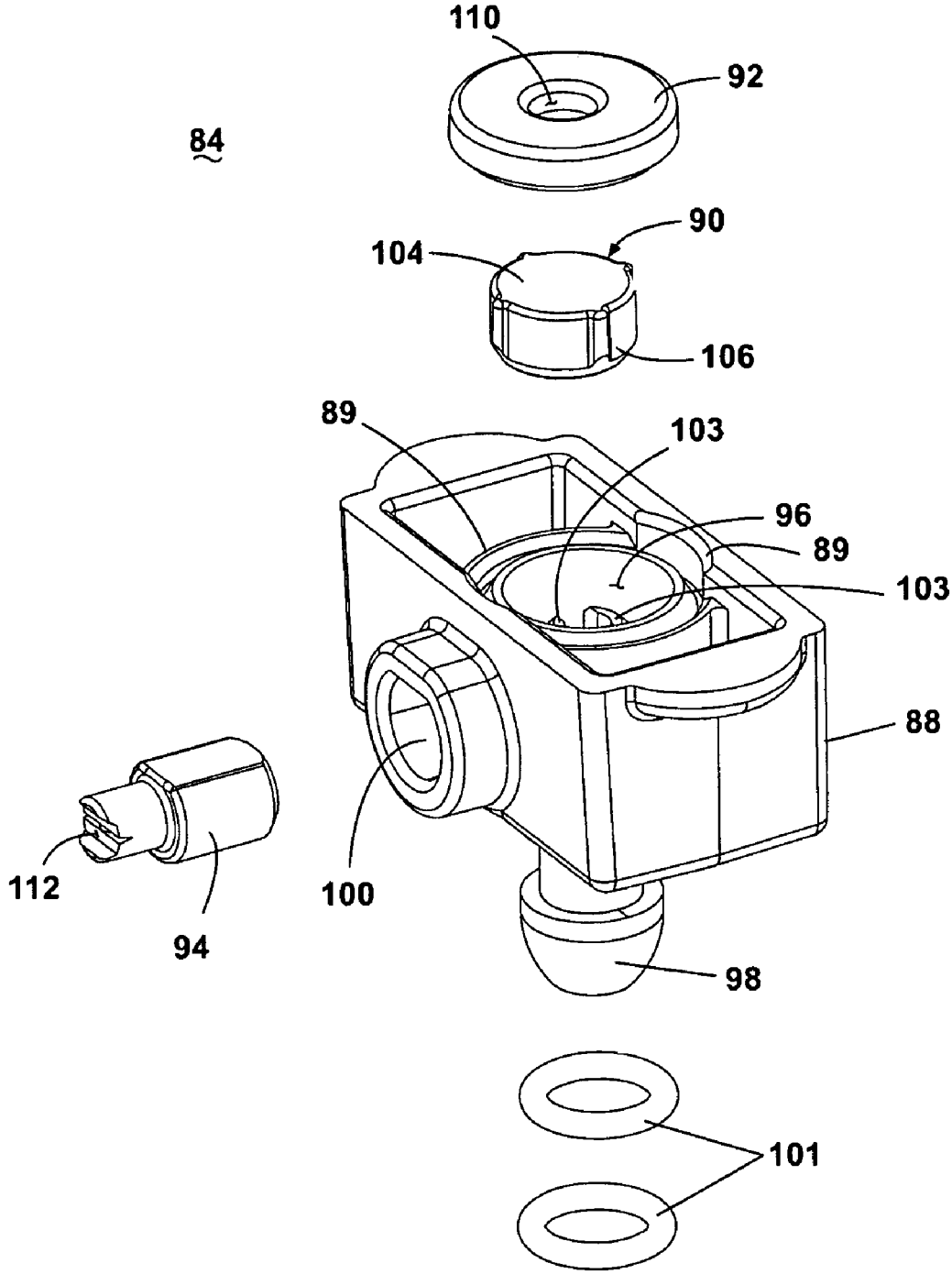
FIG. 8 is an exploded perspective view of a spray tip assembly as shown in FIG. 4.
Figure 9:
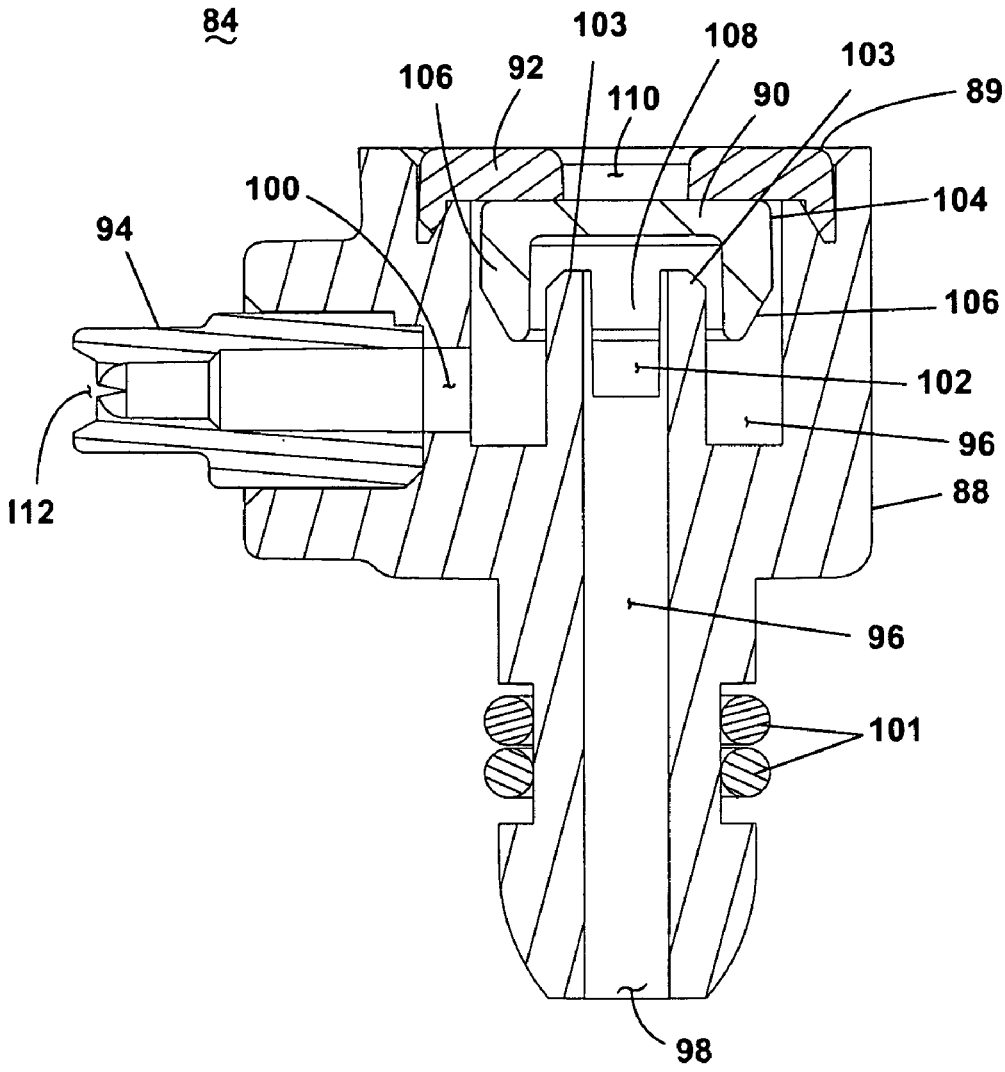
FIG. 9 is a cross-sectional view of the spray tip assembly of FIG. 4 taken along line 9-9 showing a fluid flow position.
Figure 10:
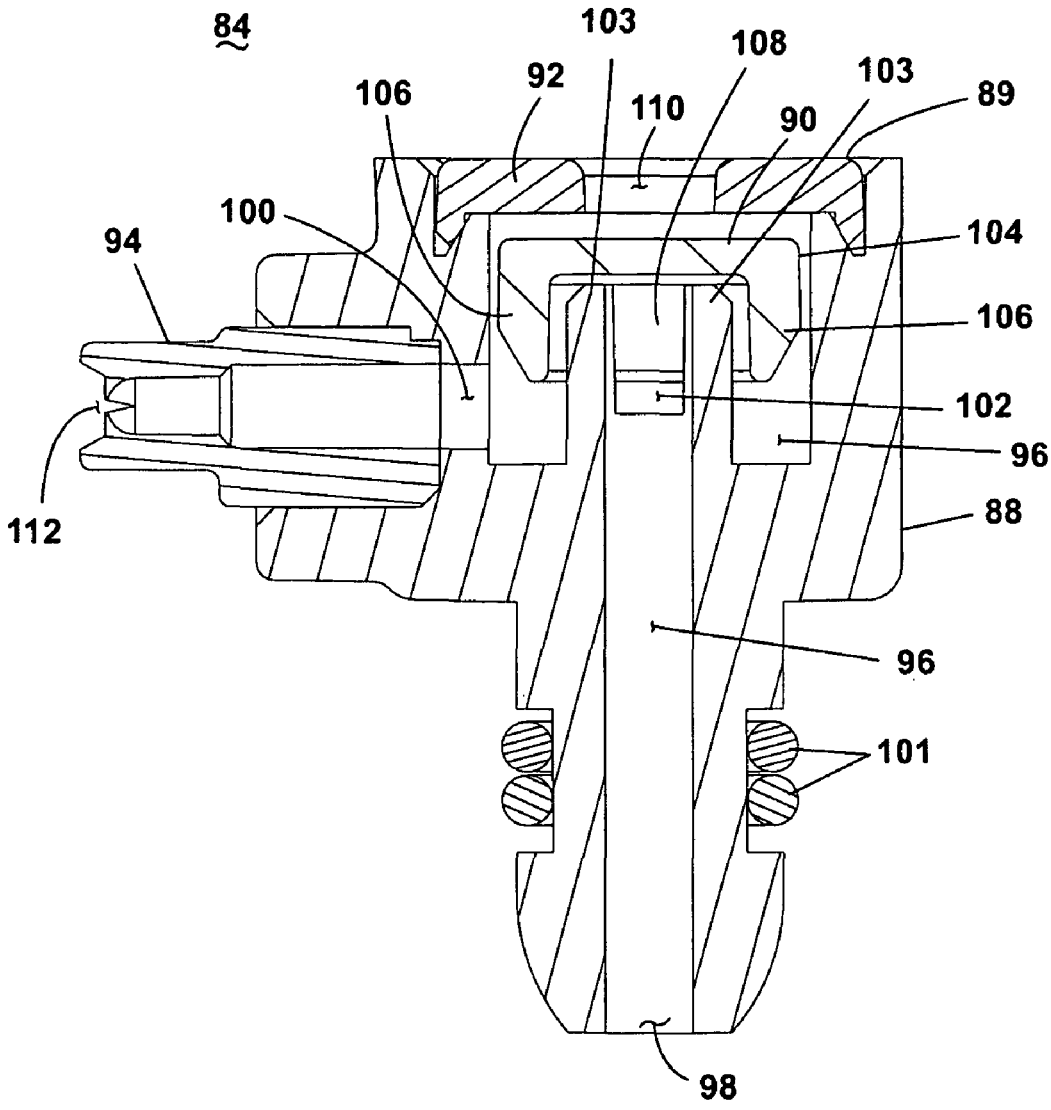
FIG. 10 is a cross-sectional view of the spray tip assembly of FIG. 4 taken along line 9-9 showing an at rest position.

Referring also to FIGS. 8 through 10, a spray tip assembly 84 can be removably received in a mounting pocket formed in part by the base housing cover 26 and secured by the spray tip cover 86. In one embodiment, the spray tip cover 86 can be molded from a transparent material and can be removed by disengaging the rib 82 from the top wall 76 of the nozzle insert housing 46 to remove the spray tip assembly 84 to clean any accumulated debris from the spray tip nozzle 94 and in the spray distribution compartment 68.

The spray tip assembly 84 comprises a spray tip housing 88, a float 90, a vented cap 92, and a spray tip nozzle 94. The spray tip housing 88 forms a fluid chamber 96 and further comprises a fluid inlet 98 and a fluid outlet 100. The fluid inlet 98 comprises a downwardly-extending and hollow neck-like portion of the spray tip housing 88. A plurality of conventional sealing rings 101 are adapted for placement about the fluid inlet 98 so as to prevent the migration of fluid to the exterior of the fluid inlet 98. The spray tip nozzle 94 can be sealingly mated to the fluid outlet 100 in any suitable manner, such as by a friction fit in an opening formed by the spray tip housing 88. The fluid chamber 96 further comprises inlet slots 102 formed between two pegs 103 and configured to selectively receive the float 90 therein. The pegs 103 are generally rectangular in shape with a slight curve and are spaced apart in a parallel relationship to form the inlet slots 102 therebetween. The float 90 comprises a flat circular disk 104 and a downwardly protruding rim 106 around the perimeter. The vented cap 92 is fitted into an opening 89 at an upper portion of the housing 88 and covers the fluid chamber 96. The cap 92 can be sealed within the opening 89 in any suitable manner, such as by sonic welding, a press-fit, an adhesive, or the like. Alternatively, the cap 92 can be removably mounted in the opening in any suitable manner, such as by a threaded connection. The cap 92 has a vent aperture 110 open to the ambient atmosphere.

The spray tip nozzle 94 comprises a V-shaped aperture 112 and extends horizontally along a centerline of the outlet face resulting in a conventional "cat-eye" orifice for the distribution of fluid in a horizontal fan-shaped spray pattern. Referring to FIG. 7, the fluid can be sprayed through the receiving aperture 74 formed in the back wall 72 of the nozzle insert housing 46 and can be deflected downward by the front spray deflection wall 70. In this configuration, a single spray tip assembly 84 can distribute fluid across the width of the entire spray distribution compartment 68.

The float 90 can be moveable between a downward position and an upward position.

Referring to FIG. 9, the spray tip assembly 84 is shown in a position where fluid is flowing. The fluid distribution system is pressurized by a fluid pump 114 which delivers fluid to the inlet opening 98. When fluid reaches the float 90, the float 90 rises until a top surface of the float 90 contacts the bottom surface of the vented cap 92 and effectively seals the fluid distribution system from the atmosphere.

When air is present in the fluid distribution system, as during start up or when new liquid is added to the fluid supply tank 20, the float 90 drops down shown in FIG. 10. A bottom surface of the float 90 rests on the pegs 103 so that a partial lower section of the inlet slots 102 are open and are in fluid communication with the ambient atmosphere through the fluid chamber 96, around the rim 106, and through the vent aperture 110. When fluid again fills the inlet 98, the fluid pushes the float 90 up to seal the cap vent aperture 110, and a steady stream of fluid flows out of the spray tip nozzle 94.

The fluid pump 114 is driven by a drive motor 116 via a shaft (not shown) that is directly coupled to the pump 114. The pump 114 draws fluid from the fluid supply tank 20 and delivers it under pressure to the spray tip assembly 84. Cleaning fluid is distributed from the fluid supply tank assembly 22 to the spray tip assembly 84 in a conventional manner. A suitable fluid distribution system incorporating a fluid supply tank is shown in U.S. Pat. No. 6,131,237 to Kasper et al. and is incorporated herein by reference in its entirety.

Referring to FIGS. 1 through 7, a roller assembly 118 is mounted under the roller housing 38 formed in the forward portion of the base housing 24 and comprises a roller element 120 that is rotatably driven by a the drive motor 116 via a drive belt 122 through a planetary gear box 124. The gear box 124 is positioned on a side of the drive motor 116 opposite the fluid pump 114 and is driven by a conventional motor shaft (not shown) in a well-known manner. A drive gear 126 is fixedly attached to the drive motor 116 shaft as is well-known and drives the belt 122. The roller assembly 118 further comprises a roller axle 128 and a pair of opposed end arms 130. The roller element 120 further comprises a generally cylindrical roller frame 132 surrounded by a cleaning medium 134. The roller frame 132 can be comprised of a chemically resistant, substantially rigid thermoplastic material such as PVC. Alternatively, the roller frame 132 can be manufactured using alternate materials, including but not limited to polypropylene, polyethylene, nylon, and the like.

The roller cleaning medium 134 surrounds the roller frame 132 and can comprise a relatively soft and compressible material. In a preferred embodiment, the roller cleaning medium 134 material is Denier Nylon with a nominal pile outer diameter of 78.5 mm and nominal nap depth of ¾" and is preferably bonded to the roller frame 132 with epoxy adhesive. Alternatively, the roller cleaning medium 134 can be tufted, fibrous, flocked, smooth, ribbed, nubbed, or otherwise textured and can comprise alternate materials such as fabrics, foams, brush bristles, rubber or any other material suitable for soil transfer and cleaning surface agitation. The cleaning medium 134 further comprises an outer peripheral surface 136 and working region 138 is defined as a portion of the cleaning medium 134 part way between the outer peripheral surface 136 and the roller frame 132. The working region 138 is particularly pliable and is the primary interface between the surface to be cleaned and the fluid extraction system.

The roller element 120 further comprises end caps 140 fixedly inserted into complementary receiving ends 142 of the roller frame 132. A through-hole extends along a central axis of each end cap 140 through a bushing (not shown) fixedly mounted thereto and provides a bearing surface for the roller axle 128. The end cap 140 can be keyed to the roller frame 134 in a conventional manner to prevent the roller frame 132 from rotating about the end caps 140. In one embodiment, the end caps 140 are permanently affixed to the roller frame 132 with epoxy adhesive. The roller assembly 118 further comprises a pair of brush gears 144 that interface with the end caps 140 at an inner portion. Each end cap 140 is permanently coupled to one of the brush gears 144, such as by using an adhesive. An outer portion of the brush gears 144 comprise a plurality of conventional gear teeth 146 that interface with the drive belt 122.

The axle 128 further comprises a key 148 at each end that interfaces with the end arms 130. The axle keys 148 prevent the axle 128 from rotating within the end arm 130. The end arms 130 are positioned on both ends of the roller element 120 and connect the roller assembly 118 to the foot assembly 12. The end arms 130 each comprise a roller mounting end 150 and a base mounting end 152. The roller mounting end 150 incorporates a belt guard 154 formed by a raised peripheral wall that protrudes towards the roller element 120 and extends around the periphery of the end arm 130. The base mounting end 152 comprises a rectangular beam section with a first raised cylindrical protrusion 156 forming a bearing surface on an outboard side thereof and a second larger diameter protrusion 158 forming a bearing surface on the inboard side. These cylindrical protrusions 156, 158 form inner and outer bearing surfaces, respectively. The end arms 130 are pivotally secured to the foot assembly 12 via corresponding half circular receivers 160 formed partially in corresponding sidewalls of both the base housing 24 and a sole plate 162. The mating surfaces of the base housing 24 and sole plate 162 receive the base mounting end 152 creating a pivoting "clamshell" mounting configuration that secures the end arms 130 and roller assembly 118 to the foot assembly 12 while allowing the roller assembly 118 to pivot, thus providing the roller element 120 with a vertical displacement that effectively disengages the roller element 120 from the nozzle housing insert 46 leading nozzle wall 54 and trailing nozzle wall 56 at the suction nozzle inlet 48 when the extraction cleaner 10 is stored.

Figure 13:
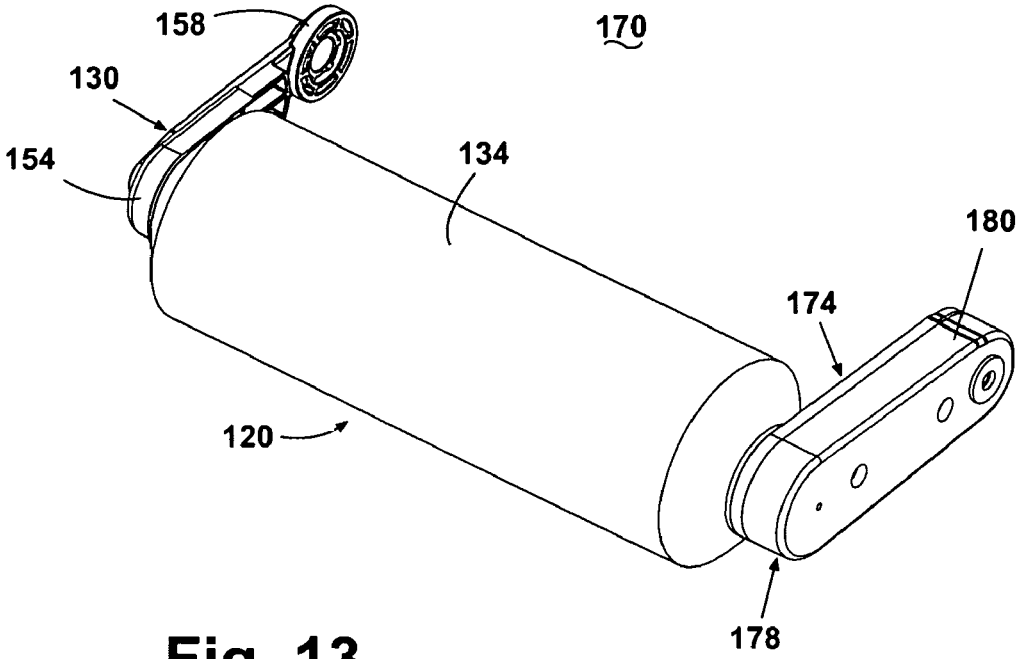
FIG. 13 is a perspective view of a second embodiment of a roller assembly for use with the foot assembly of FIG. 3.
Figure 14:
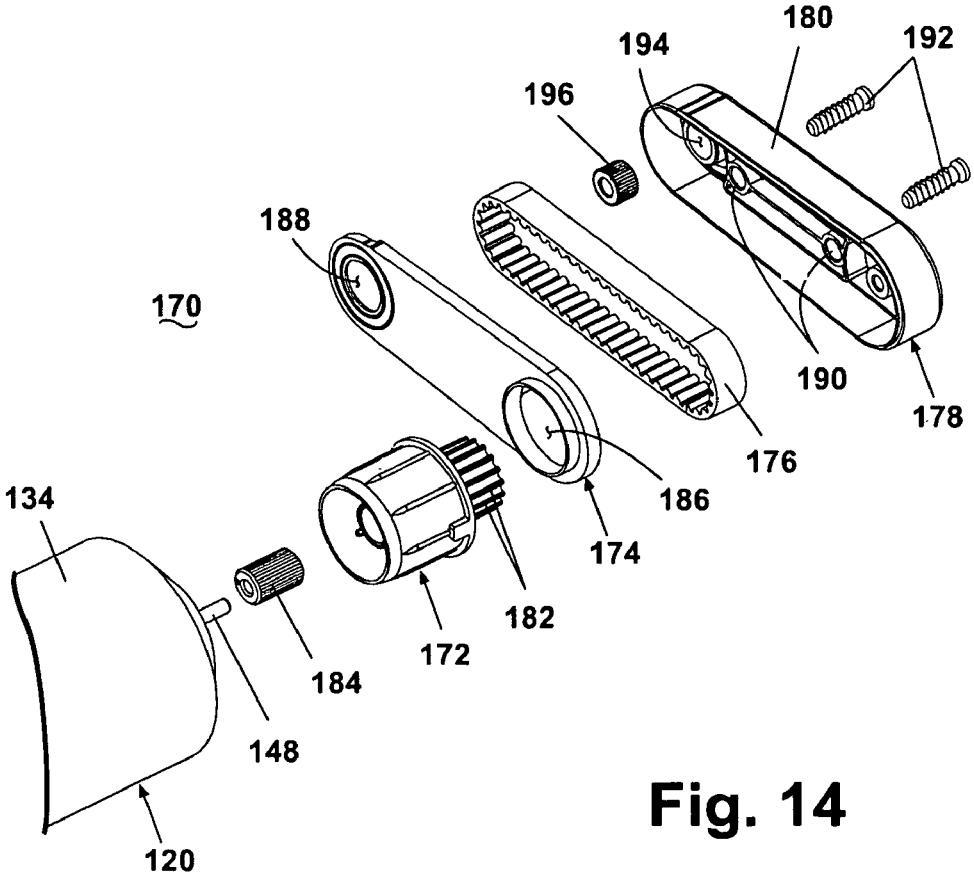
FIG. 14 is a partial exploded perspective view of the roller assembly of FIG. 13.

A second embodiment of the roller assembly 170 that is similar in part to the roller assembly 118 of the first embodiment is illustrated in FIGS. 13 and 14. Like parts will be identified with like numerals, with it being understood that the description of the like parts of the first embodiment applies to the second embodiment, unless otherwise noted. One side of the roller assembly 170 is substantially identical to the sides of the roller assembly 118 and includes identical elements, such as an end arm 130, a belt guard 154, and a second protrusion 158. The roller assembly 170 also includes roller element 120 comprising soft cleaning medium 134.

The roller assembly 170 further comprises a combination brush gear and end cap 172, a belt cover 174, a drive belt 176, and an elongated belt guard 178. The combination brush gear and end cap 172 combines the end cap 140 and brush gear 144 of the first embodiment into a single part. The combination brush gear and end cap 172 can be integrally formed and includes a plurality of gear teeth 182 that are illustrated as being slightly larger than the gear teeth 146 of the first embodiment in order to accommodate the drive belt 176, which is illustrated as being wider than the drive belt 122 of the first embodiment but is otherwise similar to the drive belt 122. The combination brush gear and end cap 172 as well as a conventional bushing 184 are adapted to be received by the roller element 120 on the roller axle 128 and over the axle key 148.

The brush cover 174 comprises an elongated member having rounded ends and is configured for coupling to the elongated belt guard 178. The brush cover 174 comprises a roller opening 186 and a driving opening 188 extending therethrough and positioned adjacent the roller element 120 and drive gear 26, respectively, when the upright extractor 10 is assembled.

The elongated belt guard 178, in effect, combines the end arm 130 and belt guard 154 of the first embodiment by extending the belt guard 154 to surround and include the end arm 130. The elongated belt guard 178 comprises an inwardly-extending flange 180 about a perimeter thereof and also includes two openings 190 therethrough. Each opening is configured to receive one of two conventional screws 192. The screws 192 are configured for receipt by each of two corresponding bosses (not shown) positioned on an interior surface of the belt cover 174. The elongated belt guard 178 further comprises a recess 194 configured to receive a bearing 196. The bearing 196 is adapted to receive a tip of the shaft of the drive motor 116.

When assembled, the screws 192 extend through the openings 190 and into the bosses on the interior of the brush cover 174 to couple the brush cover 174 and elongated belt guard 178 and to define a belt chamber (not shown) therebetween. The roller element 120 receives the bushing 184 and combination brush gear and end cap 172 such that the gear teeth 182 extend outside the interior of the roller element 120 and through the roller opening 186 for engagement with the drive belt 176, which is contained in the belt chamber. The axle key 148 is also received by the elongated belt guard 178 in a manner preventing rotation of the roller axle 128 within the belt chamber. At the same time, the end of the shaft of the drive motor 116 having the drive gear 126 thereon extends through the driving opening 188 of the brush cover 174, and the tip of the shaft is received within the bearing 196. The shaft 116 can then rotate the drive gear 126 within the belt chamber to drive the drive belt 176. The drive belt 176 then transmits the rotations to the roller element 120 via the gear teeth 182 of the combination brush gear and end cap 172.

In order to provide reversibility of the roller element 120 in the second embodiment as discussed hereinafter, a brush gear (not shown) and end cap (not shown) on the side of the roller assembly 170 substantially identical to the sides of the roller assembly 118 can have a size and configuration identical to the brush gear portion of the combination brush gear and end cap 172. This provides both sides of the roller element 120 with gear teeth 182 of the size and configuration necessary for proper engagement with the drive belt 176.

The roller element 120 can be removed for cleaning and replacement. To complete such an operation, the sole plate 162 can be accessed by the user from beneath the foot assembly 12 and can be removed via commonly known mechanical fasteners, such as screws or snaps. The sole plate 162 can be removed, thus releasing the roller assembly 118, 170 from the foot assembly 12 at the base mounting end 152. The end arms 130 can be removed from the axle 128 by releasing the key 148. In the second embodiment, the screws 192 can also be unscrewed to separate the brush cover 174 and the elongated belt guard 178, and the key 148 can be released to remove the axle 128 from the elongated belt guard 178. The roller element 120 can then be removed and rotated 180 degrees to reverse the direction of orientation. Reversing the roller element 120 can extend the life of the cleaning medium 134 by forcing the flattened, settled fibers in the working region 138 to rise and expand to a like-new condition. Providing identical brush gears at both end caps further simplifies the roller element 120 reversal process.

When the extraction machine 10 is in the use position, the roller assembly 118, 170 is compressed between the surface to be cleaned and the nozzle insert housing 46. As previously described, the nozzle insert housing 46 trailing nozzle wall 56 is longer than the leading nozzle wall 54 and extends below the leading nozzle wall 54. In the use configuration, the leading nozzle wall 54 interfaces the cleaning medium 134 at the outer peripheral surface 136. The trailing nozzle wall 56 penetrates the pliable working region 138 of the cleaning medium 134.

In operation, the user engages a conventional fluid distribution actuator (not shown) on the upright extractor 10 to start the flow of fluid from the fluid supply tank 22 to the fluid pump 114 and into the spray tip assembly 84. Fluid passes through the spray tip nozzle 94 of the spray tip assembly 84 where the stream is converted to a fan-shaped pattern that impacts the deflection wall 70. The fluid drips down the deflection wall 70 under gravity and is absorbed by the working region 138 of the cleaning medium 134. The cleaning medium 134 is rotated in a forward or counter-clockwise direction via the drive belt 122, 176 drive as previously described. Sufficient fluid is delivered to the working region 138 to saturate the cleaning medium 134. The saturated working region 138 passes under the suction nozzle inlet 48 where the trailing wall 56 acts like a squeegee to remove excess fluid from the working region 138. The slightly damp portion of the working region 138 continues to rotate and contacts the surface to be cleaned where residual fluid is transferred to the surface to be cleaned and loose debris is transferred from the surface to be cleaned to the working region 138.

The debris-embedded working region 138 continues to rotate and passes beneath the deflection wall 70 where additional cleaning fluid is applied. The debris- and fluid-embedded working region 138 then passes beneath the suction nozzle inlet 48 where both loose debris and excess fluid are removed. This cycle is repeated at a rate sufficient to wipe the surface to be cleaned. In the preferred embodiment, the cleaning medium 134 completes about 200 rotations per minute. Alternatively, the cleaning medium 134 can be configured to complete between 100 and 400 rotations per minute.

Figure 11:
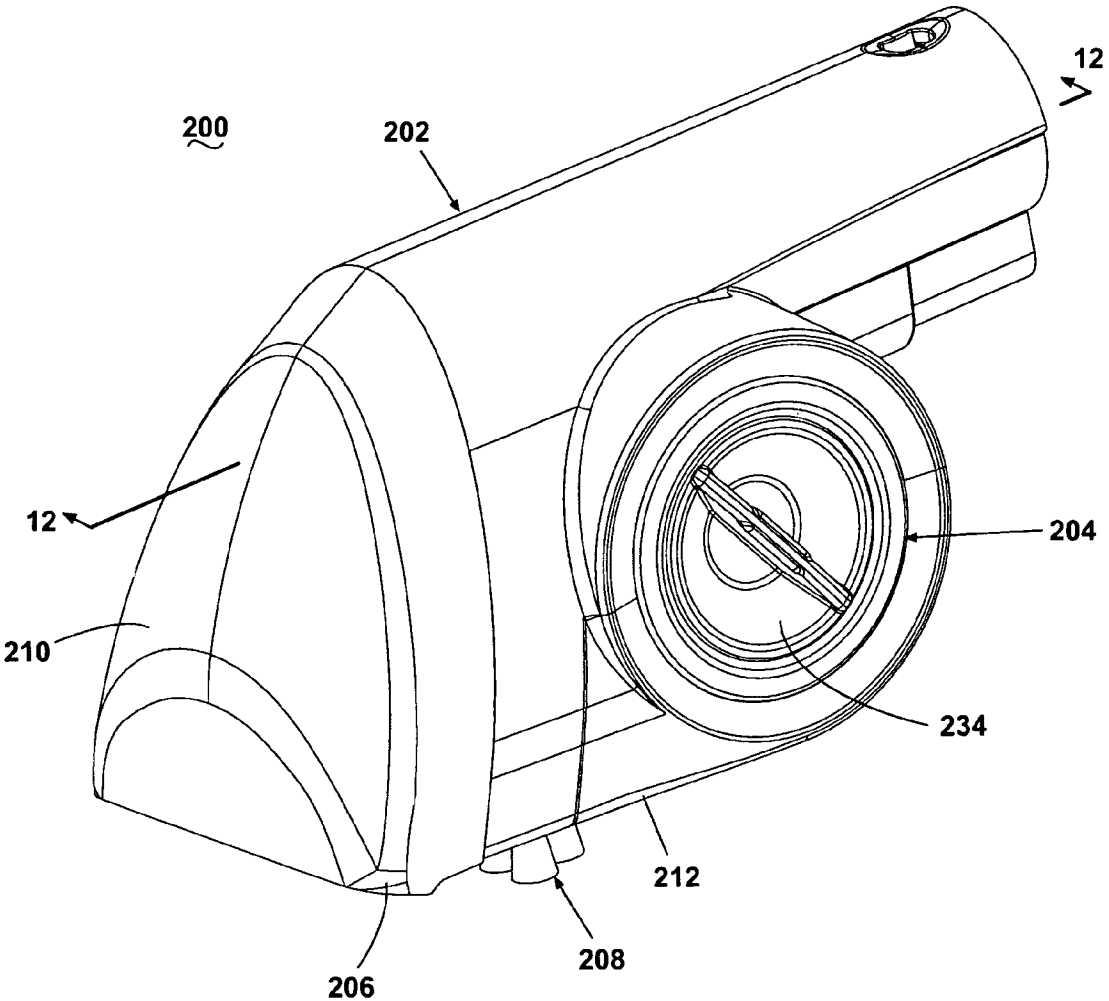
FIG. 11 is a perspective view of an accessory tool according to the invention.
Figure 12:
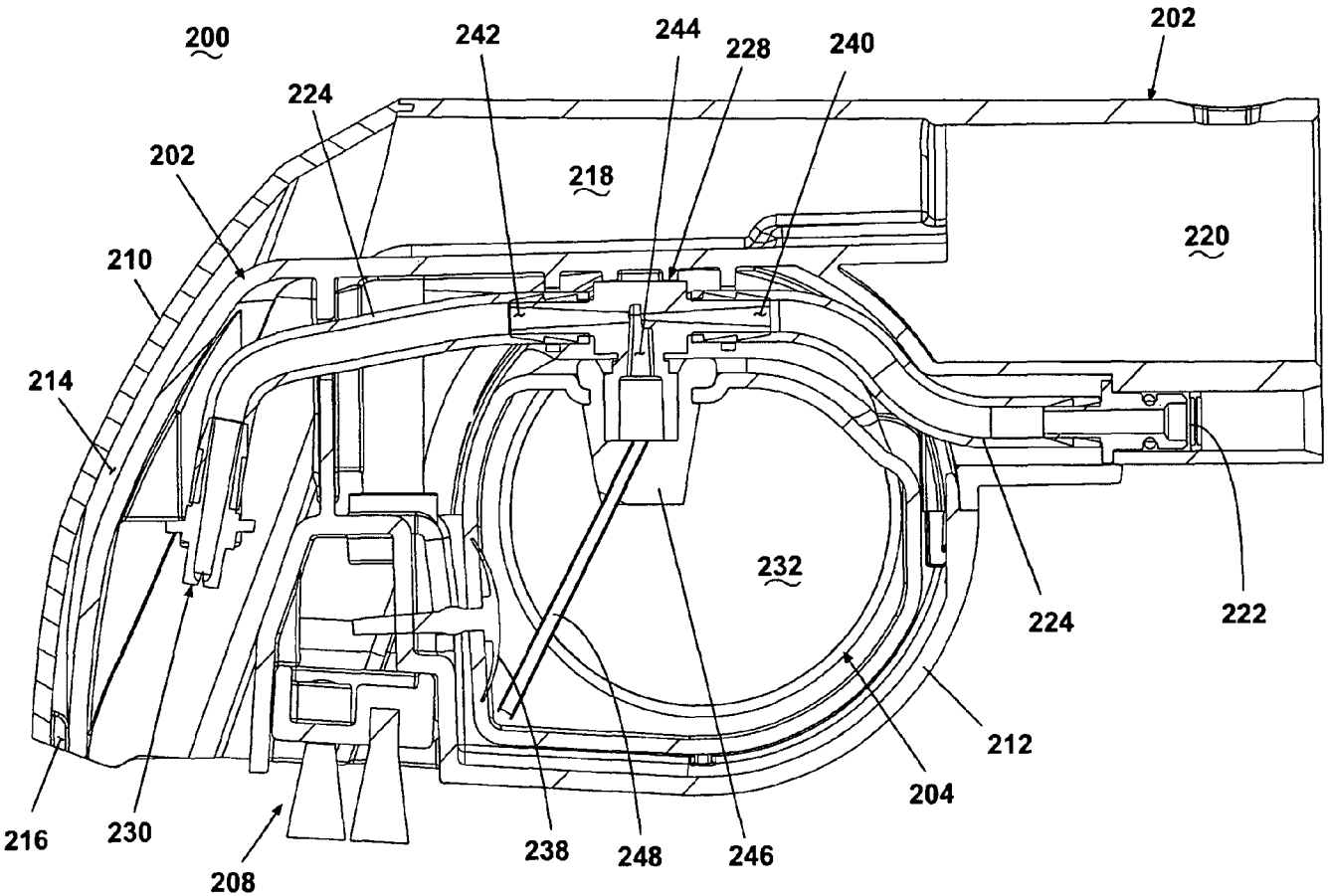
FIG. 12 is a cross-sectional view of the accessory tool taken along line 12-12 of FIG. 11.

Referring to FIGS. 11 and 12, the accessory tool 200 can be attached to a conventional upholstery hose fitting (not shown) for selective fluid delivery and fluid extraction through a conventional upholstery hose as controlled by user-operable valve means. The accessory tool 200 comprises a tool body assembly 202 encasing a solution reservoir assembly 204, a brush assembly 208 of the well-known variety, a nozzle window 210, and a bottom cover 212. The solution reservoir assembly 204 can contain any suitable cleaning or surface treatment fluid, such as but not limited to detergent, stain repellant, water, oxygen bleaching formulas, and anti-stain/anti-soil treatments.

The suction nozzle window 210 can be mounted to a front surface of the tool body 202 and is spaced apart from a front forward wall of the tool body 202 to form a suction nozzle flow path 214 therein that terminates in a suction nozzle inlet 216 at one end. The suction nozzle flow path 214 extends upwardly and rearwardly and joins a suction conduit 218 formed within the tool body 202. A suction conduit outlet 220 is shaped to the upholstery hose fitting for transporting fluid and entrained debris from the surface to be cleaned back to the recovery tank assembly 20.

The fluid delivery system comprises a fluid inlet 222, tubing 224, the solution reservoir assembly 204, a venturi injector assembly 228, and a spray nozzle assembly 230. The solution reservoir assembly 204 is encased between the tool body 202 and the bottom cover 212 and further comprises a fluid container 232, a removable fill cap 234, an injector orifice and an umbrella vent valve 238. The venturi injector assembly 228 further comprises an inlet 240, an outlet 242, and a siphon channel 244. The venturi injector assembly 228 is retained in the injector orifice by an injector assembly seal 246. A siphon tube 248 is fluidly connected to the injector assembly 228 through the injector assembly seal 246. The siphon tube 248 is oriented downwardly from the injector assembly seal 246 toward the umbrella valve 238 and approaches the fill cap 234. Both the umbrella valve 238 and the siphon tube 248 are oriented in an upward position and away from the surface of the water line in the fluid container 232 when the accessory tool 200 is in either a filling orientation or when stored on the handle 14 so as to minimize leakage. The siphon tube 248 remains below the water line when the accessory tool 200 is oriented for use.

In operation, the extraction machine 10 is powered to energize the drive motor 116 to drive the fluid pump 114 and the fluid extraction system. The fluid pump 114 pressurizes the fluid distribution system and provides pressurized fluid to the stain tool 200. Upon actuation of a conventional fluid distribution actuator (not shown) on the upholstery hose, fluid is delivered from the extraction machine 10 to the stain tool inlet 222. Pressurized fluid then flows via inlet tubing 224 through the venturi injector assembly 228, over the injector siphon channel 244, through the outlet 242, and out the spray nozzle assembly 230 to the surface to be cleaned. As the fluid passes over the injector siphon channel 244, fluid in the fluid container 232 is drawn up and into the outlet tubing 224 due to the venturi effect and mixes with the fluid being delivered from the extraction machine 10.

During extraction, fluid and debris from the surface to be cleaned are drawn from the surface to be cleaned through the accessory tool suction nozzle inlet 216, into the working air conduit 214, into the upholstery hose, and finally to the recovery tank 20 where the fluid and entrained debris are collected for eventual disposal.

While the invention has been specifically described in connection with certain specific embodiments thereof, it is to be understood that this is by way of illustration and not of limitation, and the scope of the appended claims should be construed as broadly as the prior art will permit.

What is claimed is:

1. An upright extractor comprising:

a foot assembly including base housing for movement along a surface to be cleaned;

a fluid supply system mounted to the base housing and including a fluid tank, a fluid distributor for depositing fluid onto the surface to be cleaned, and a fluid conduit between the fluid tank and the fluid distributor; and a fluid recovery system mounted to the base housing and including a suction nozzle, a recovery tank, a working air conduit between the suction nozzle and the recovery tank, and a motor/fan assembly adapted to draw liquid through the suction nozzle and deposit the liquid in the recovery tank;

wherein the distributor comprises:

a spray tip housing having an inlet opening connected to the fluid conduit; and an outlet opening connected to a spray nozzle;

a chamber formed in the spray tip housing in communication with the inlet opening and the outlet opening;

a vent opening in communication with the atmosphere and with the chamber; and a float valve mounted in the chamber and moveable from a sealing position in sealing relationship with the vent opening to seal the chamber from the atmosphere when fluid under pressure is delivered to the chamber from the fluid conduit and a vent position in spaced relationship with the vent opening to vent the chamber to the atmosphere when the fluid in the fluid conduit is unpressurized.

2. The upright extractor of claim 1 wherein the spray tip housing has a cap opening between the atmosphere and the chamber and a cap mounted in the cap opening, and wherein the vent opening is formed in the cap.

3. The upright extractor of claim 2 and further comprising a removable panel mounted in the base housing directly above the spray tip housing for user access to the spray tip housing.

4. The upright extractor of claim 3 wherein the cap is positioned directly adjacent the removable panel.

5. The upright extractor of claim 4 wherein the removable panel is at least translucent for user visibility to the spray tip housing.

6. The upright extractor of claim 1 and further comprising a removable panel mounted in the base housing directly above the spray tip housing for user access to the spray tip housing.

7. The upright extractor of claim 6 wherein at least a portion of the removable panel is at least translucent for user visibility to the spray tip housing.

8. The upright extractor of claim 1 and further comprising a roller having an outer layer of a soft cleaning medium mounted to the base housing for contact with a surface to be cleaned and the spray tip housing is mounted in the base housing in a position to distribute cleaning fluid from the spray nozzle onto the surface of the roller cleaning medium to apply cleaning fluid to the surface to be cleaned.

9. The upright extractor of claim 8 and further comprising a deflection wall mounted above the roller and in registry with the spray nozzle, whereby cleaning fluid sprayed from the spray nozzle impinges on the deflection wall and drips onto the soft cleaning medium of the roller.

10. The upright extractor of claim 9 wherein the suction nozzle has a suction opening positioned in contact with the soft cleaning medium of the roller to remove fluid and debris therefrom.

11. The upright extractor of claim 8 wherein the roller is adapted be removably and reversibly mounted to the base housing for contacting the surface to be cleaned.

12. The upright extractor of claim 11 wherein the roller is mounted to the base housing for selective placement in two mutually exclusive positions 180 degrees perpendicular to the axis of the roller.

13. The upright extractor of claim 12 and further comprising a drive motor operably connected to the roller, and brush gears mounting the roller to the base housing for providing slippage between the roller and the drive motor in the event that a resistance created by the roller exceeds a predetermined limit.

14. The upright extractor of claim 12 wherein the roller has brush gears at each end that interface with a drive mechanism for driving the roller about a longitudinal axis.

15. The upright extractor of claim 1, wherein the distributor is removably mounted in the base housing.

16. An upright extractor comprising:

a foot assembly including a base housing for movement along a surface to be cleaned;

a fluid supply system mounted at least in part to the base housing and including a fluid tank, a fluid distributor, and a conduit between the fluid tank and the fluid distributor for depositing fluid onto the surface to be cleaned;

a fluid recovery system mounted to the base housing and including a suction nozzle, a recovery tank, a working air conduit between the suction nozzle and the recovery tank, and a motor/fan assembly adapted to draw liquid through the suction nozzle and deposit the liquid in the recovery tank; and a roller removably and reversibly mounted in base housing for contacting the surface to be cleaned;

wherein the roller has brush gears at each end that interface with a drive mechanism for driving the roller about a longitudinal axis.

17. The upright extractor of claim 16 wherein the roller has an outer layer of a soft cleaning medium mounted to the base housing for contact with a surface to be cleaned.

* * * * *